US011430352B2

(12) United States Patent
Su et al.

(10) Patent No.: US 11,430,352 B2
(45) Date of Patent: Aug. 30, 2022

(54) CURVED SURFACE DISPLAYING MODULE

(71) Applicant: Brogent Technologies Inc., Kaohsiung (TW)

(72) Inventors: Pei-Te Su, Kaohsiung (TW); Kuan-Chih Liu, Kaohsiung (TW); Tak-Hon Lee, Kaohsiung (TW)

(73) Assignee: BROGENT TECHNOLOGIES INC., Kaohsiung (TW)

( * ) Notice: Subject to any disclaimer, the term of this patent is extended or adjusted under 35 U.S.C. 154(b) by 128 days.

(21) Appl. No.: 17/039,202

(22) Filed: Sep. 30, 2020

(65) Prior Publication Data

US 2022/0058988 A1 Feb. 24, 2022

(30) Foreign Application Priority Data

Aug. 19, 2020 (TW) ..... 109128272

(51) Int. Cl.
*G09F 9/30* (2006.01)
*G09F 9/302* (2006.01)

(52) U.S. Cl.
CPC ..... *G09F 9/301* (2013.01); *G09F 9/3026* (2013.01)

(58) Field of Classification Search
CPC .... G06F 1/1641; G06F 1/1647; G06F 1/1652; G09F 9/301; G09F 9/3026
See application file for complete search history.

(56) References Cited

U.S. PATENT DOCUMENTS 9,854,701 B2 * 12/2017 Choi ..... F16M 11/043
2008/0263924 A1 * 10/2008 Nearman ..... G09F 15/0012 40/607.13
2012/0260483 A1 * 10/2012 Patterson ..... H05K 999/99 29/428
2015/0029166 A1 * 1/2015 Park ..... G09G 3/03 345/184
2015/0145837 A1 * 5/2015 Park ..... H04N 21/42204 345/184
2015/0192952 A1 * 7/2015 Jung ..... G06F 1/20 361/747
2016/0231976 A1 * 8/2016 Ryu ..... G06F 3/1446
2018/0124932 A1 * 5/2018 Seo ..... G09F 9/3026

* cited by examiner

*Primary Examiner* — Joe H Cheng
(74) *Attorney, Agent, or Firm* — Birch, Stewart, Kolasch & Birch, LLP

(57) ABSTRACT

A curved-surface displaying module is adapted to be disposed on a curved-surface support and includes a display panel and at least one restricting device. The curved-surface support has an engaging surface and a reverse surface which face opposite directions. The display panel has a displaying surface and a reverse surface which face opposite directions. The reverse surface of the display panel is adapted to be connected to the engaging surface. The restricting device is disposed on the reverse surface of the display panel. The restricting device includes a restricting member. The restricting member has a connecting portion and a restricting portion. An end of the connecting portion is pivotally connected to the reverse surface of the display panel, and another end of the connecting portion is connected to the restricting portion. The restricting portion of the restricting member is controllable to pivot to the reverse surface of the curved-surface support.

7 Claims, 12 Drawing Sheets

CURVED SURFACE DISPLAYING MODULE

This application claims priority under 35 U.S.C. § 119 of Taiwan Application No. TW 109128272 filed on Aug. 19, 2020, the disclosure of which is incorporated by reference.

BACKGROUND OF THE INVENTION

Technical Field

The present invention relates generally to a displaying module with a curved surface, and more particularly to a restricting device which could be applied to a curved-surface displaying module.

Description of Related Art

In recent years, the development of display screen technology has become more and more mature. Flat display screens have been widely used in various occasions. On some special occasions, such as astronomical exhibition halls, movie theaters, advertising screens, etc., arc-shaped display screens are used to provide a visual shock and an immersive viewing experience with a wider angle of view to the audience.

A conventional arc-shaped display screen is typically formed by splicing and mounting a plurality of displaying modules on a support. However, to make the displaying modules an arc shape, the displaying modules must be accurately arranged at specific positions on the support. After the displaying modules are mounted on the support, there is likely to be a gap between two adjacent displaying modules, which cause a problem that some specific arc shapes cannot be achieved. In addition, the displaying modules are fixed on the support usually by magnetic force. As a result, when the displaying modules are mounted on the support, the displaying modules are easily disengaged from the support due to being subject to an external force collision, which may cause damage to the displaying modules and hurt staff. In all aspects, the conventional displaying module still has room for improvements.

BRIEF SUMMARY OF THE INVENTION

In view of the above, the primary objective of the present invention is to provide a curved-surface displaying module, which could prevent from accidentally disengaging from the support due to an external force.

The present invention provides a curved-surface displaying module, which is adapted to be disposed on a curved-surface support, wherein the curved-surface support has an engaging surface and a reverse surface which face opposite directions. The curved-surface displaying module includes a display panel and at least one restricting device, wherein the display panel has a displaying surface and a reverse surface which face opposite directions. The reverse surface of the display panel is adapted to be connected to the engaging surface of the curved-surface support. The at least one restricting device is disposed on the reverse surface of the display panel, wherein the at least one restricting device includes a restricting member. The restricting member has a connecting portion and a restricting portion. An end of the connecting portion is pivotally connected to the reverse surface of the display panel, another end of the connecting portion is connected to the restricting portion. The restricting portion of the restricting member is controllable to pivot to the reverse surface of the curved-surface support. Thereby, the display panel is fixed on the curved-surface support via the at least one restricting device. When there are a plurality of curved-surface displaying modules engaged with the curved-surface support, the displaying surface of the display panel of the plurality of the curved-surface displaying modules forms a curved displaying surface.

With the aforementioned design, when the curved-surface displaying module is mounted on the curved-surface support, the restricting portion of the restricting member could be operated to pivot to the reverse surface of the curved-surface support. In this way, when the curved-surface displaying module is subject to an external force collision, the curved-surface displaying module could be prevented from falling from the curved-surface support. In addition, when the user is about to take the curved-surface displaying module down from the curved-surface support, the user could manipulate the restricting portion of the restricting member to pivot to a position away from the reverse surface of the curved-surface support, which facilitates the user to detach the curved-surface displaying module.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
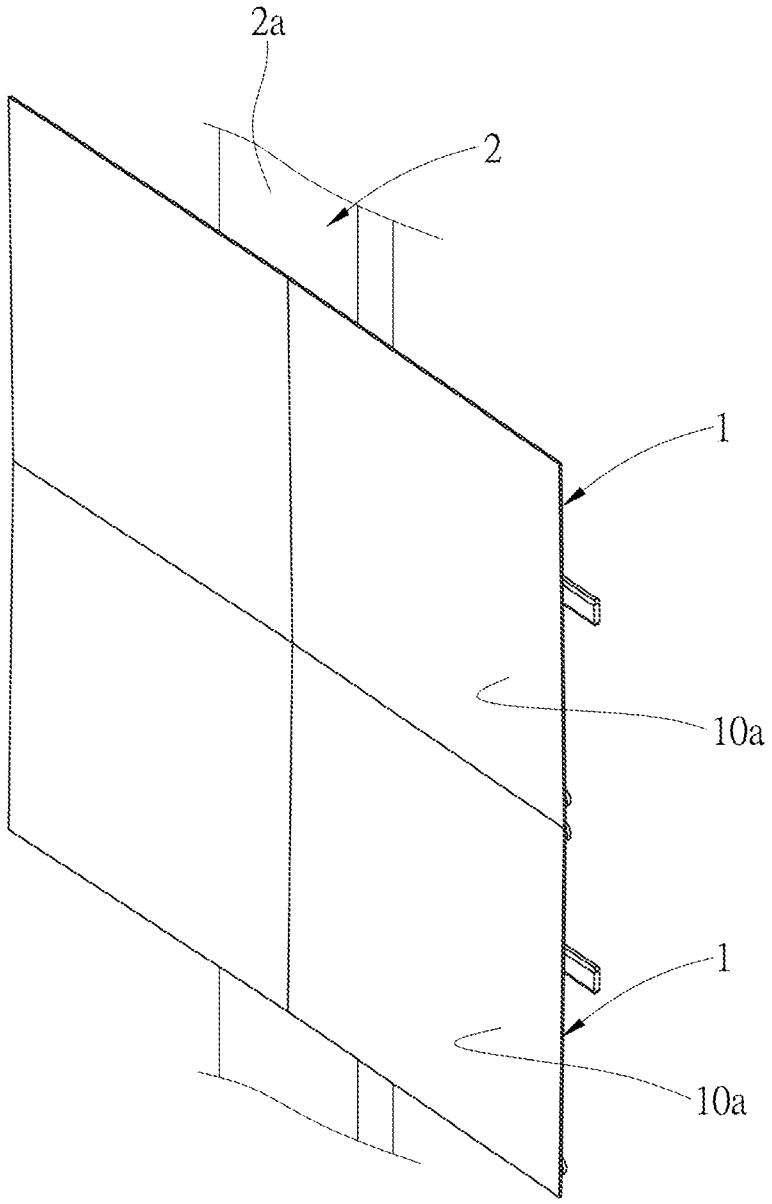
FIG. 1 is a perspective view of the curved-surface displaying module according to an embodiment of the present invention.
Figure 2:
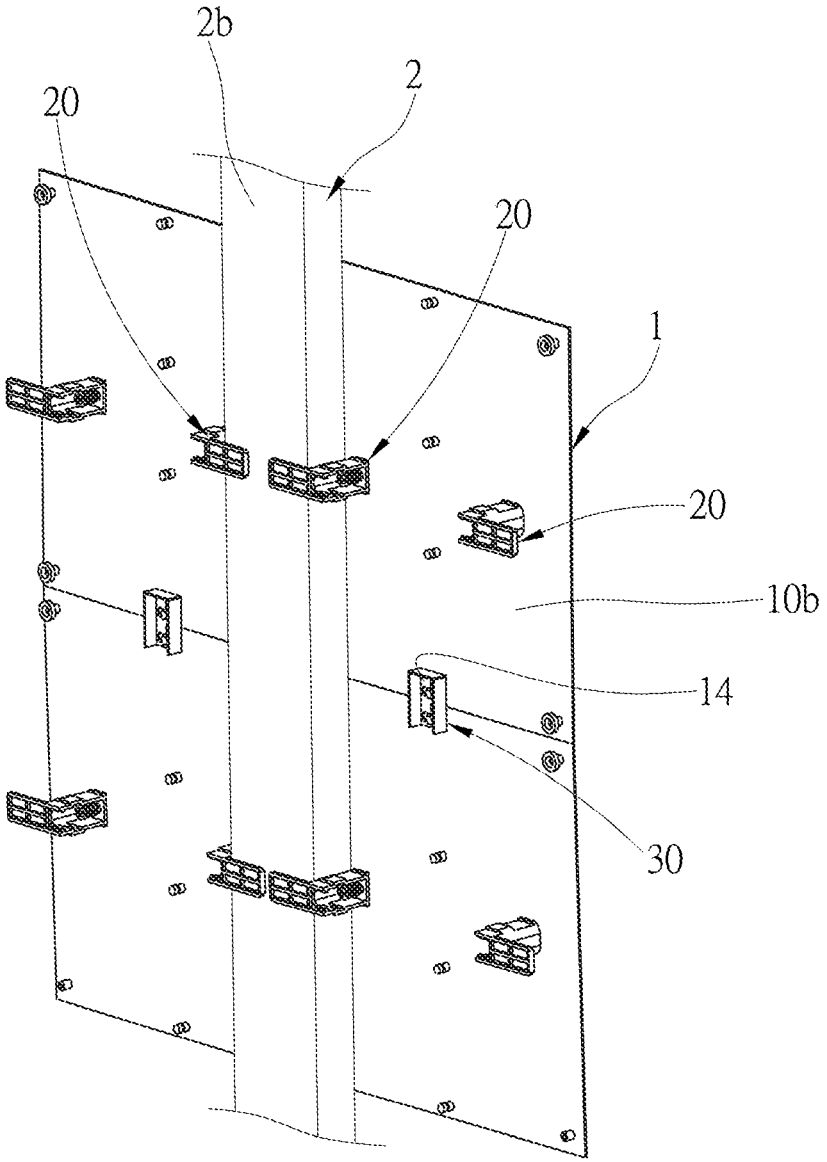
FIG. 2 is a perspective view of the curved-surface displaying module according to the embodiment of the present invention.
Figure 3:
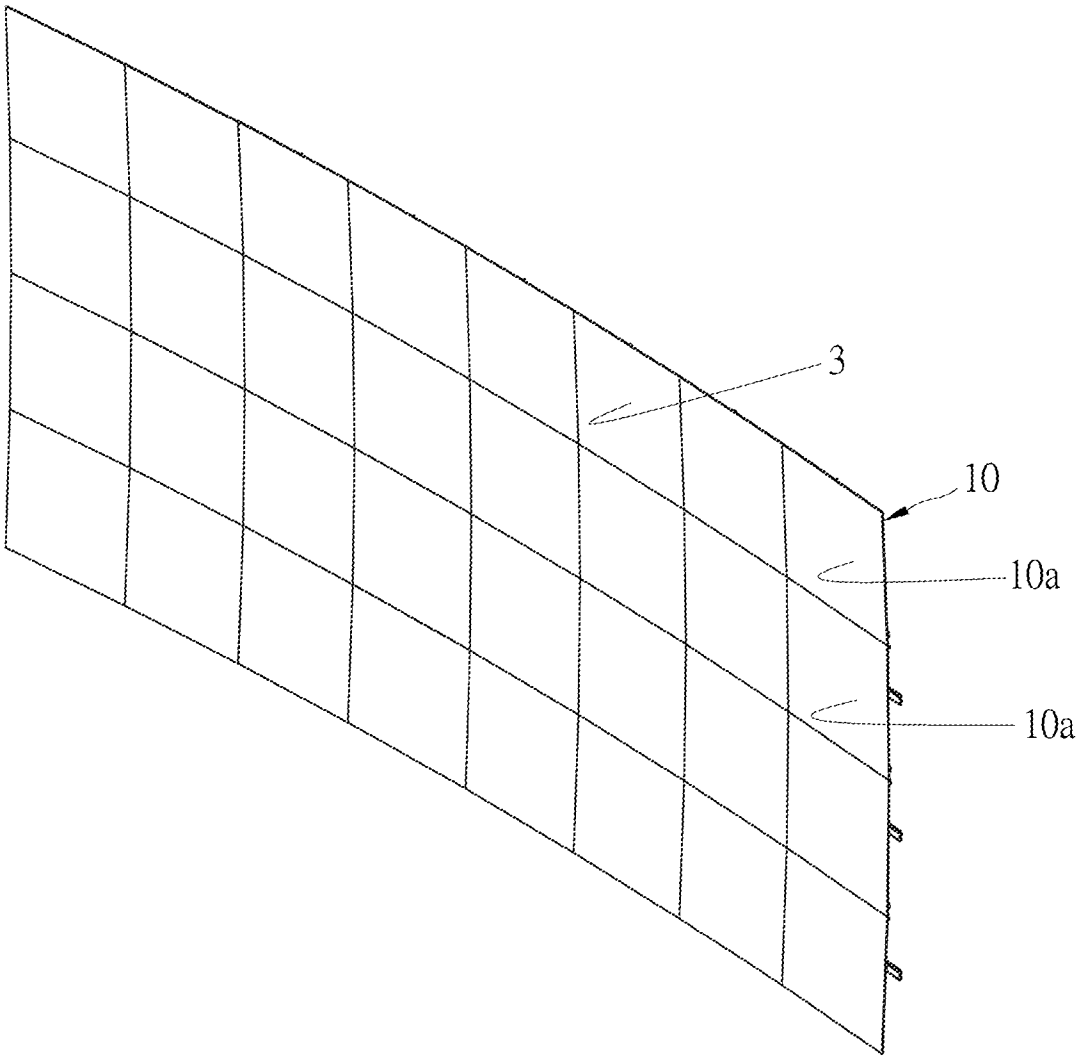
FIG. 3 is a perspective view of the curved-surface displaying module according to the embodiment of the present invention.
Figure 4:
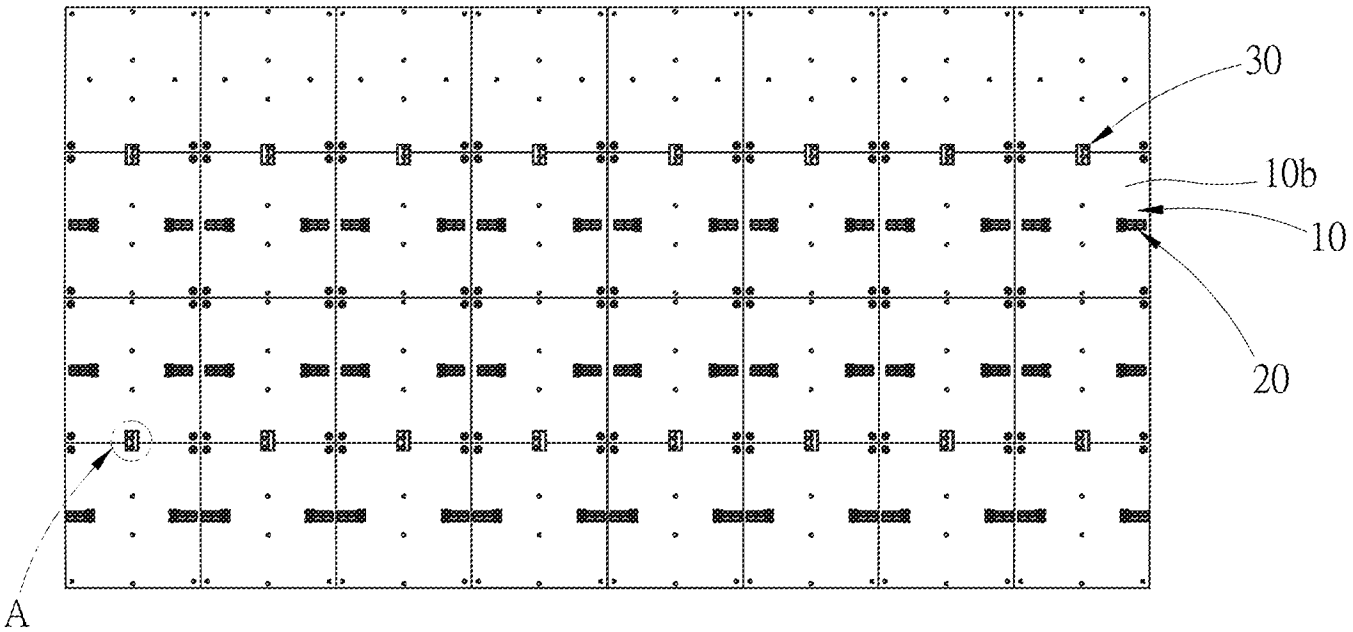
FIG. 4 is a rear view of the curved-surface displaying module according to the embodiment of the present invention.

A curved-surface displaying module 1 according to an embodiment of the present invention is illustrated in FIG. 1 to FIG. 11. As shown in FIG. 1 and FIG. 2, the curved-surface displaying module 1 is adapted to be disposed on a curved-surface support 2, wherein the curved-surface support 2 has an engaging surface 2*a* and a reverse surface 2*b* which face opposite directions. The curved-surface displaying module 1 includes a display panel 10 and two restricting devices 20, wherein the display panel 10 has a displaying surface 10*a* and a reverse surface 10*b* which face opposite directions. The reverse surface 10*b* of the display panel 10 is connected to the engaging surface 2*a* of the curved-surface support 2. In this way, when there are a plurality of curved-surface displaying modules 1 disposed on the curved-surface support 2, the displaying surfaces 10*a* of the plurality of curved-surface displaying modules 1 are connected to form a curved displaying surface 3 shown in FIG. 3. In the current embodiment, the display panel 10 is, but not limited to, a light emitting diode (LED) panel as an example.

Figure 5:
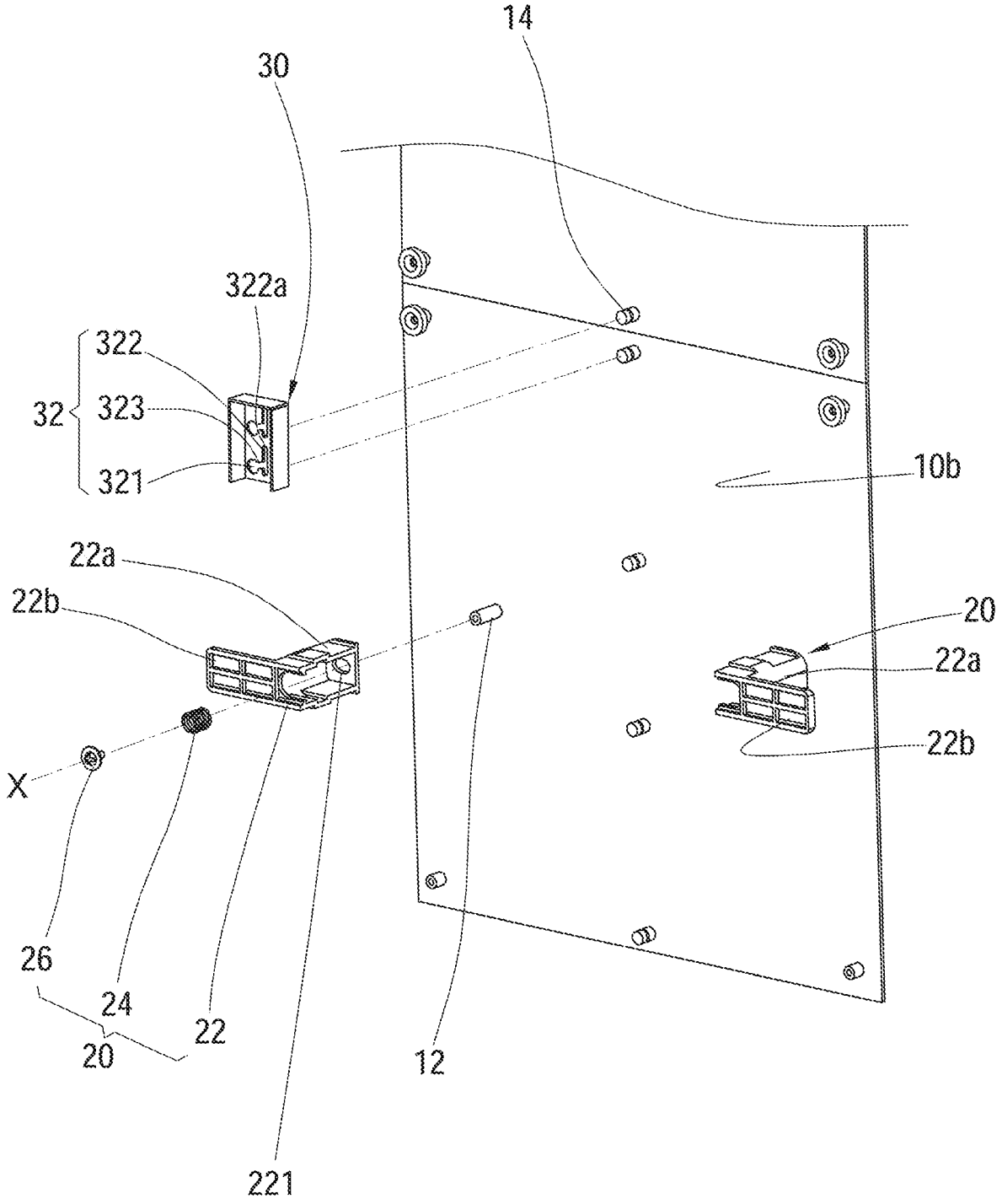
FIG. 5 is a partially exploded view showing the components of the curved-surface displaying module according to the embodiment of the present invention.
Figure 6:
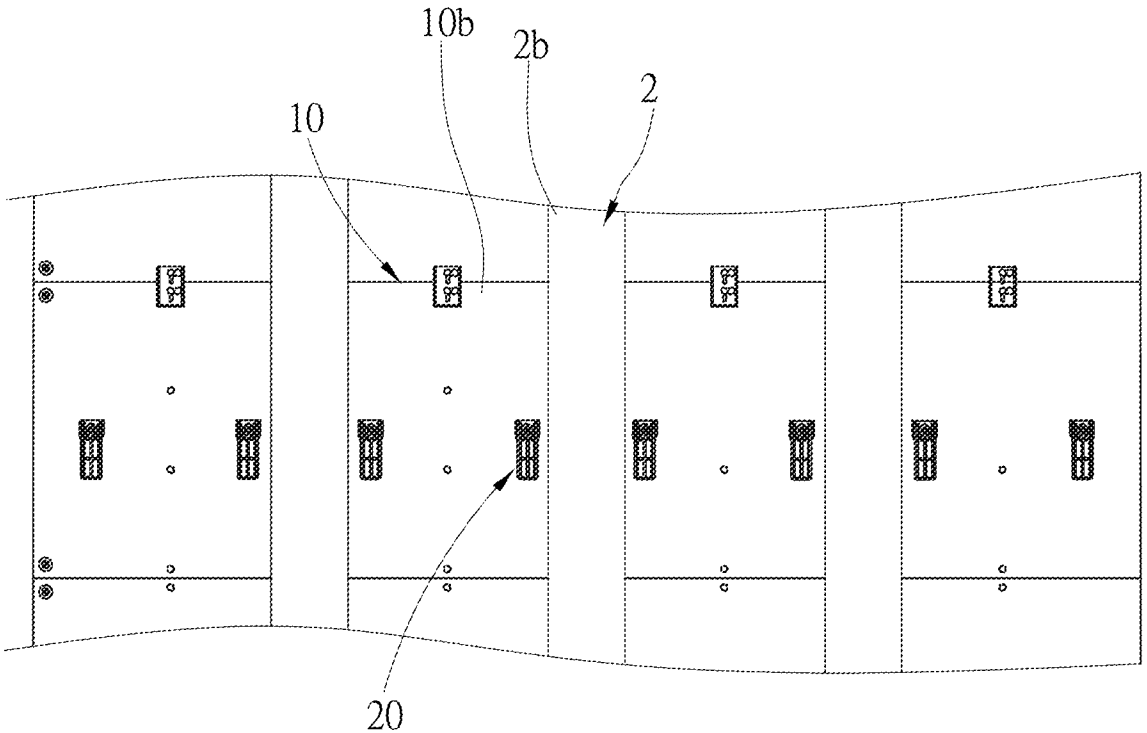
FIG. 6 is a schematic view showing the operation of the curved-surface displaying module according to the embodiment of the present invention.
Figure 7:
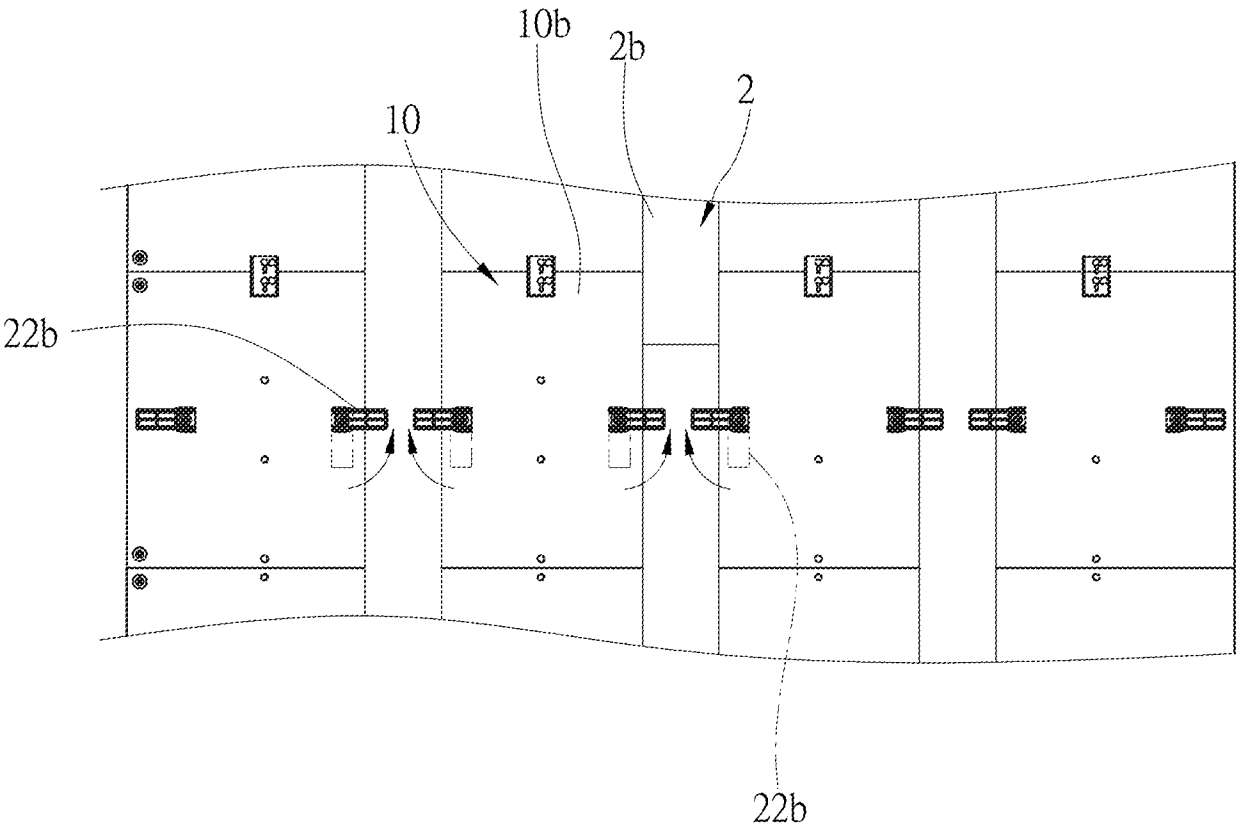
FIG. 7 is a schematic view showing the operation of the curved-surface displaying module according to the embodiment of the present invention.

Referring to FIG. 4 to FIG. 7, the restricting devices 20 are in groups of two and are oppositely disposed on the reverse surface 10*b* of the display panel 10, wherein each of the restricting devices 20 includes a restricting member 22. Each of the restricting members 22 has a connecting portion 22*a* and a restricting portion 22*b*, wherein an end of the connecting portion 22*a* is connected to the reverse surface 10*b* of the display panel 10, and another end of the connecting portion 22*a* is connected to the restricting portion 22*b*. When each of the restricting devices 20 is connected to the reverse surface 10*b* of the display panel 10, the restricting portion 22*b* of each of the restricting members 22 could be manipulated to pivot to the reverse surface 2*b* of the curved-surface support 2 as shown in FIG. 6 and FIG. 7. In this way, when the curved-surface displaying module 1 is mounted on the curved-surface support 2, the restricting portion 22*b* of each of the restricting members 22 could be manipulated by a user to pivot to the reverse surface 2*b* of the curved-surface support 2, so that when the curved-surface displaying module 1 is subject to an external force collision, the curved-surface displaying module 1 could be prevented from falling from the curved-surface support 2. In addition, when the user is about to take the curved-surface displaying module 1 down from the curved-surface support 2, the user manipulates the restricting portion 22*b* of the restricting member 22 to pivot to a position away from the reverse surface 2*b* of the curved-surface support 2, which facilitates the user to detach the curved-surface displaying module 1.

Referring to FIG. 5, more specifically, the display panel 10 includes two upright posts 12, wherein each of the upright posts 12 is disposed on the reverse surface 10*b* of the display panel 10 and has a longitudinal axis X extending in a direction away from the reverse surface 10*b* of the display panel 10. The connecting portion 22*a* of each of the restricting members 22 has an engaging hole 221, wherein each of the restricting member 22 fits around one of the upright posts 12 via the engaging hole 221, thereby the restricting portion 22*b* of each of the restricting members 22 could be controlled by the user to pivot around the longitudinal axis X of one of the upright posts 12. In the current embodiment, the upright posts 12 are a set of two and are oppositely disposed on the reverse surface 10*b* of the display panel 10. In practice, a number of the upright post could be one or more than two, which could achieve a function of being fitted by the restricting member 22 as well.

Referring to FIG. 5, each of the restricting devices 20 includes an elastic member 24 and a fixing member 26. In the current embodiment, the elastic member 24 is a compression spring as an example. In practice, the elastic member 24 could be other components that can provide elasticity. Each of the elastic members 24 fits around one of the upright posts 12. Each of the fixing members 26 is connected to an end of one of the upright posts 12 away from the reverse surface 10*b* of the display panel 10. An end of the elastic member 24 abuts against the connecting portion 22*a*, and another end of the elastic member 24 abuts against the fixing member 26. In this way, when the user controls each of the restricting portion 22*b* of the restricting member 22 to pivot around the longitudinal axis X of one of the upright posts 12, the restricting portion 22*b* of each of the restricting members 22 could maintain the degree rotated by the user via an elastic force of the elastic member 24.

Figure 8:
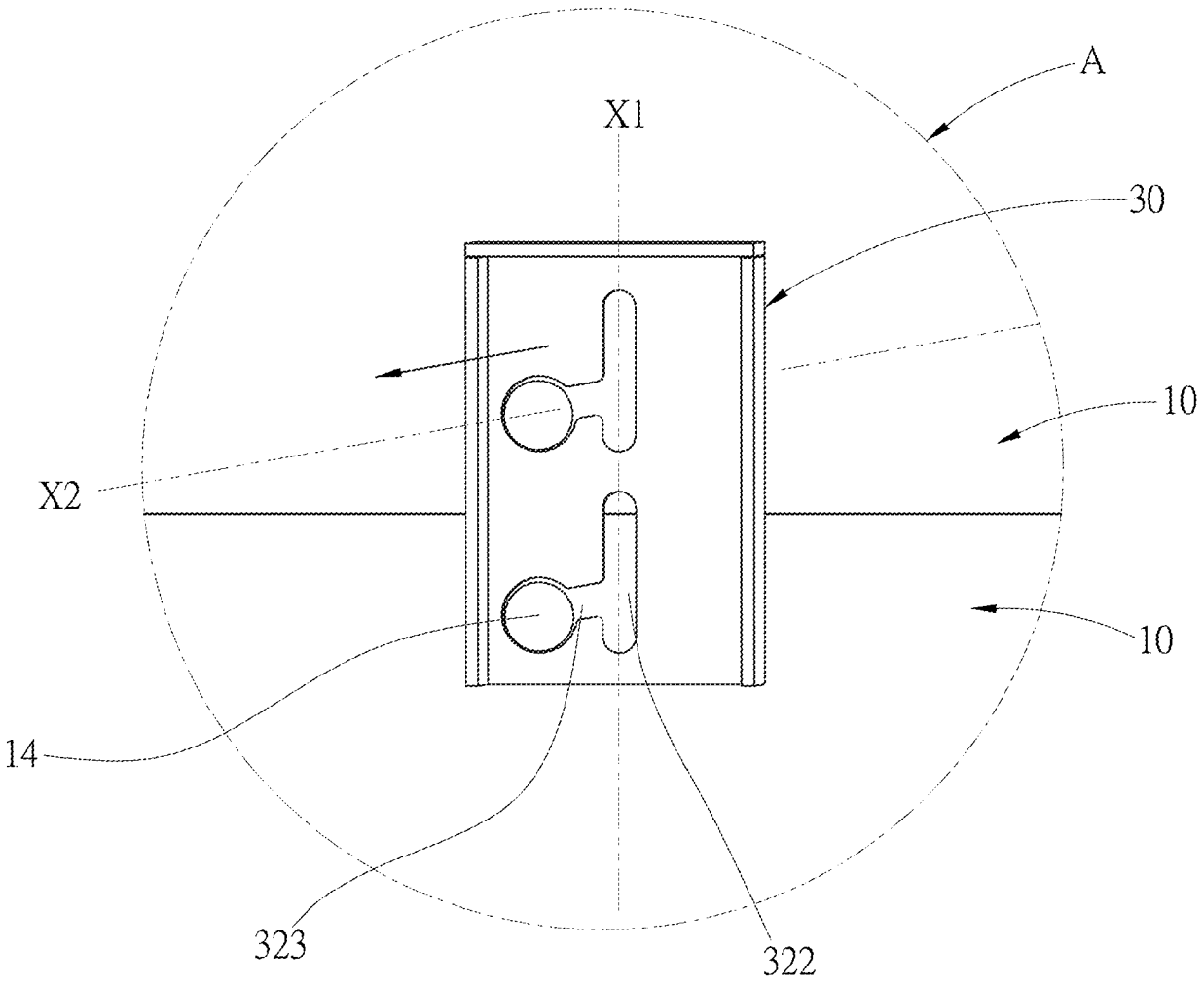
FIG. 8 is an enlarged partial view of a marked region A in FIG. 4, showing the operation of the curved-surface displaying module according to the embodiment of the present invention.
Figure 9:
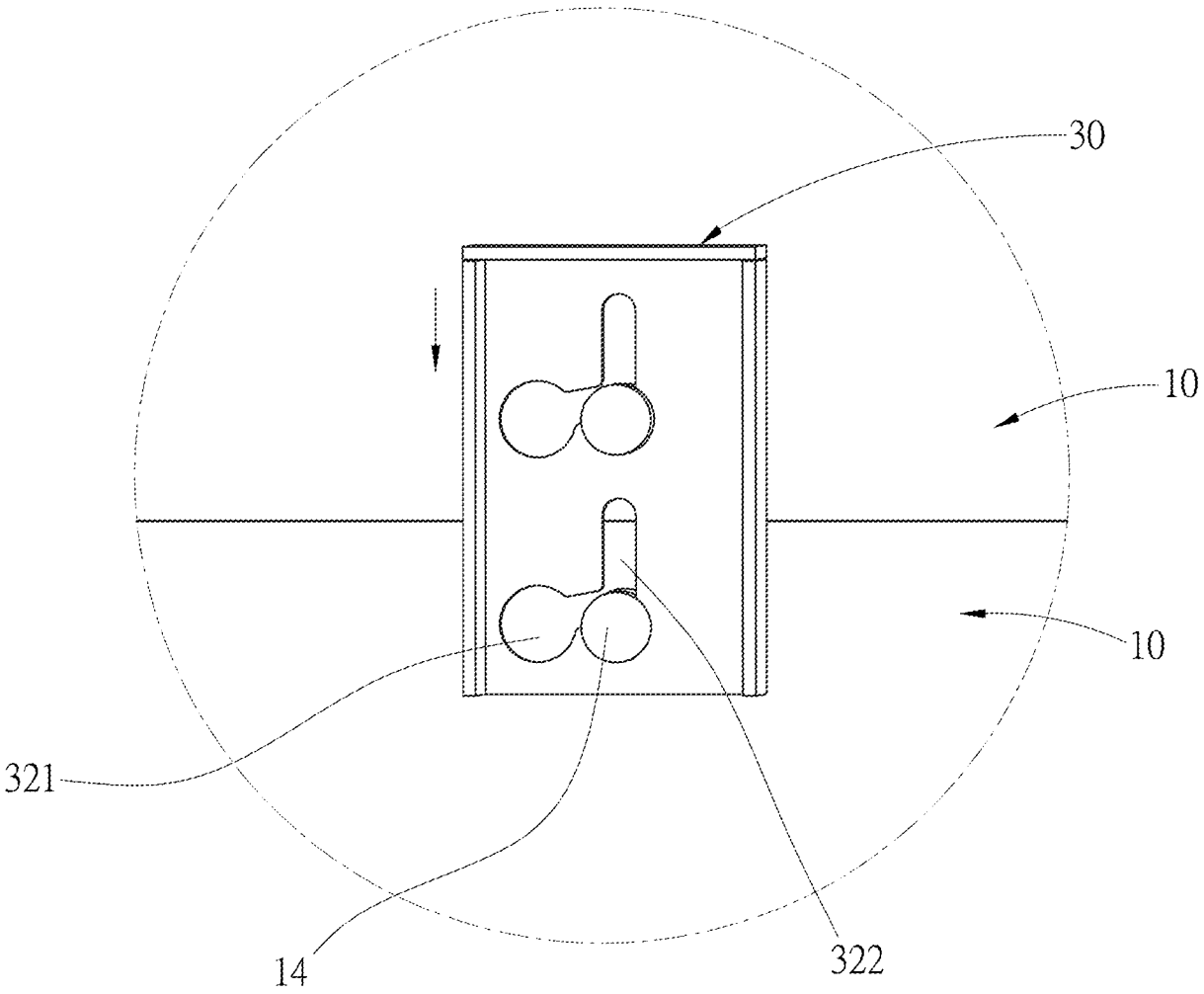
FIG. 9 is similar to FIG. 8, showing the operation of the curved-surface displaying module according to the embodiment of the present invention.
Figure 10:
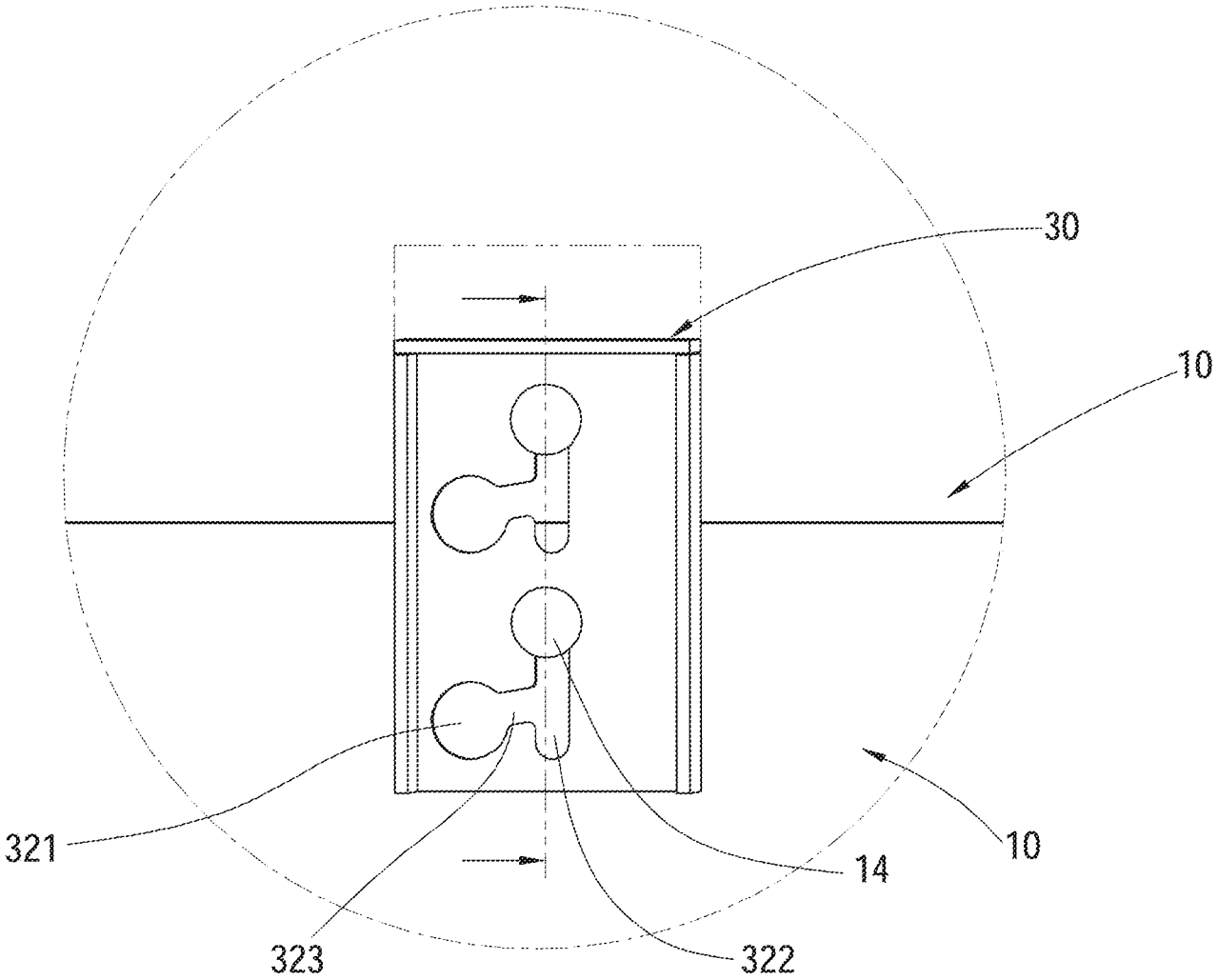
FIG. 10 is similar to FIG. 8, showing the operation of the curved-surface displaying module according to the embodiment of the present invention.

Referring to FIG. 5, it is worth mentioning that, the curved-surface displaying module 1 includes a leveling structure 30, wherein the leveling structure 30 has two through holes 32. Each of the through holes 32 has a first section 321, a second section 322, and a connecting section 323, wherein two ends of the connecting section 323 are respectively connected to the first section 321 and the second section 322. In the current embodiment, the first section 321 is a circular hole, and each of the second section 322 and the connecting section 323 is an elongate hole. Referring to FIG. 8, the second section 322 extends along a first axis X1, and the connecting section 323 extends along a second axis X2, wherein the first axis X1 is not parallel to the second axis X2. A minimum diameter of the first section 321 is greater than a minimum diameter of the second section 322 and a minimum diameter of the connecting section 323.

Figure 11:
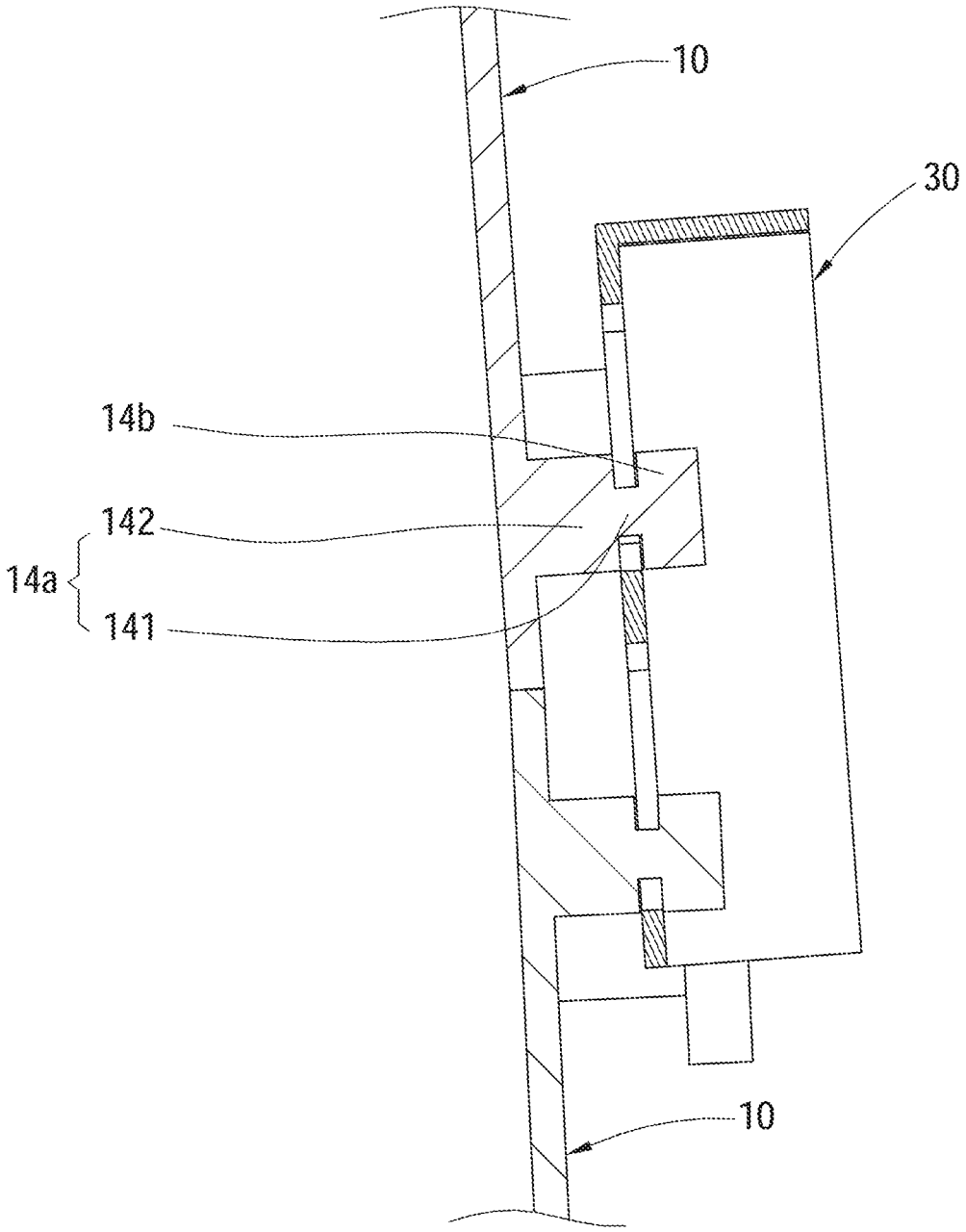
FIG. 11 is a sectional view along the B-B line in FIG. 10.

Referring to FIG. 11, the reverse surface 2*b* of the display panel 10 has an engaging member 14, wherein the engaging member 14 has an engaging portion 14*a* extending in a direction away from the reverse surface 10*b* of the display panel 10 and a head portion 14*b* which are sequentially connected. An outer diameter of the head portion 14*b* is greater than the minimum diameter of the second section 322 and the minimum diameter of the connecting section 323 and is smaller than the minimum diameter of the first section 321. A minimum outer diameter of the engaging portion 14*a* is smaller than the minimum diameter of the second section 322 and the minimum diameter of the connecting section 323.

In this way, referring to FIG. 8 to FIG. 11, when there are two display panels 10 adjacently disposed, the leveling structure 30 fits around the engaging portion 14*a* by respectively passing the head portion 14*b* of the engaging member 14 of the two display panels 10 through the first section 321 of the two through holes 32, wherein the leveling structure 30 is controllable to move relative to the engaging member 14 of the two display panels 10, thereby the engaging member 14 of the two display panels 10 enters the second section 322 along the connecting section 323; then, the leveling structure 30 moves downward relative to the engaging member 14 of the two display panels 10 along the first axis X1, thereby the engaging member 14 of each of the two display panels 10 is located at the second section 322 of one of the through holes 32 and correspondingly abuts against a closed end 322*a* of the second section 322.

Thereby, two display panels 10, which are disposed adjacently, are connected via the leveling structure 30, so that when the curved-surface displaying module 1 is subject to an external force collision, the curved-surface displaying module 1 could be prevented from easily disengaging from the curved-surface support 2. In addition, in the current embodiment, since the second section 322 extends along the first axis X1 which is not parallel to the second axis X2 that the connecting section 323 extends, each of the upright posts 12 could be prevented from entering the first section 321 from the second section 322 when the leveling structure 30 is accidentally touched by someone, thereby preventing the leveling structure 30 from disengaging from the upright posts 12. In the current embodiment, an angle between the first axis X1 and the second axis X2 is an obtuse angle. In practice, the angle between the first axis X1 and the second axis X2 could be an acute angle, which could also provide an effect of preventing the leveling structure 30 from disengaging from the upright posts 12 due to the leveling structure 30 is accidentally touched by someone.

In the current embodiment, the first section 321 is a circular hole as an example, and each of the second section 322 and the connecting section 323 is an elongate hole as an example. However, in other embodiments, the first section 321, the second section 322, and the connecting section 323 could be holes with other shapes. For instance, the first section 321 could be an elongate hole. In addition, in other embodiments, the connecting section 323 of each of the through holes 32 could be omitted, that is, the first section 321 is directly connected to the second section 322, as long as a user could fit the leveling structure 30 around the engaging portion 14*a* by respectively passing the head portion 14*b* of the engaging member 14 of the two display panels 10 through the first section 321 of the two through holes 32 to control the leveling structure 30 to move relative to the engaging member 14 of the two display panels 10 to make the engaging member 14 of the two display panels 10 enter the second section 322 and abut against the closed end 322*a* of the second section 322, achieving an effect of connecting two adjacent display panels 10. Moreover, in the current embodiment, a number of the engaging member 14 is one as an example. In practice, the number of the engaging member could be more than one.

Referring to FIG. 11, in the current embodiment, the engaging portion 14*a* of the engaging member 14 has a neck section 141 and an engaging section 142, wherein an end of the engaging section 142 is connected to the reverse surface 10*b* of the display panel 10, and another end of the engaging section 142 is connected to the neck section 141. The neck section 141 is connected to the head portion 14*b*. An outer diameter of the neck section 141 is smaller than an outer diameter of the engaging section 142, and the outer diameter of the engaging section 142 is greater than the minimum diameter of the second section 322, thereby the leveling structure 30 could be disposed on the neck section 141 located between the head portion 14*b* and the engaging section 142, achieving an effect of reducing a height difference between two adjacent curved-surface displaying modules 1 and enabling the two adjacent curved-surface displaying modules 1 to be close to each other. In other embodiments, the engaging portion 14*a* could merely have the neck section 141, that is, an end of the neck section 141 is connected to the reverse surface 10*b* of the display panel 10, and another end of the neck section 141 is connected to the head portion 14*b*, thereby the leveling structure 30 could be disposed on the neck section 141 located between the head portion 14*b* and the reverse surface 10*b* of the display panel 10, which could also achieve an effect of reducing a height difference between two adjacent curved-surface displaying modules 1 and enabling the two adjacent curved-surface displaying modules 1 to be close to each other.

Figure 12:
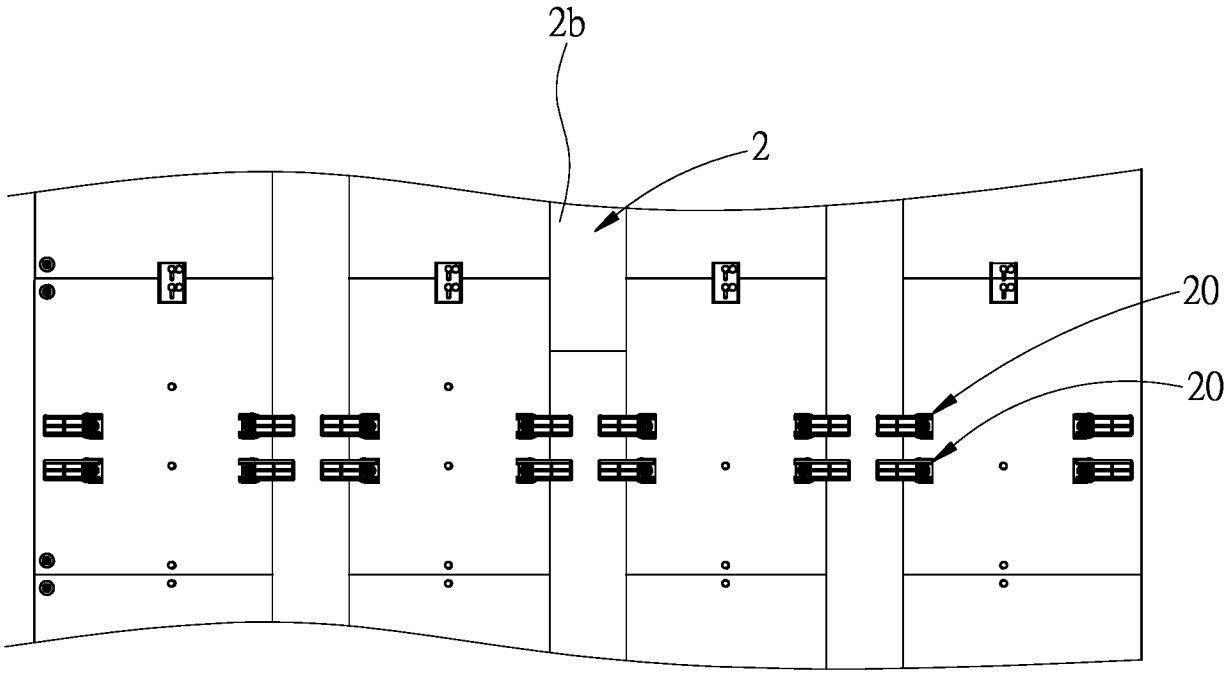
FIG. 12 is a schematic view of the curved-surface displaying module according to another embodiment of the present invention.

In the current embodiment, the restricting devices 20 are in groups of two and are oppositely disposed on the reverse surface 10*b* of the display panel 10. However, in practice, a number of the restricting device could be one or more than two. For instance, more than two restricting devices 20 are disposed on the reverse surface 10*b* of the display panel 10 as shown in FIG. 12, thereby to firmly disposed the curved-surface displaying module 1 on the curved-surface support 2.

With the aforementioned design, the restricting devices 20 and the leveling structure 30 of the curved-surface displaying module 1 could prevent the curved-surface displaying module 1 from falling from the curved-surface support 2 when the curved-surface displaying module 1 is subject to an external force collision. In addition, the leveling structure 30 of the curved-surface displaying module 1 could further reduce the height difference between two adjacent curved-surface displaying modules 1.

It must be pointed out that the embodiments described above are only some preferred embodiments of the present invention. All equivalent structures which employ the concepts disclosed in this specification and the appended claims should fall within the scope of the present invention.

What is claimed is:

1. A curved-surface displaying module, which is adapted to be disposed on a curved-surface support, wherein the curved-surface support has an engaging surface and a reverse surface which face opposite directions; the curved-surface displaying module comprising:

a display panel having a displaying surface and a reverse surface which face opposite directions, wherein the reverse surface of the display panel is adapted to be connected to the engaging surface of the curved-surface support;

at least one restricting device disposed on the reverse surface of the display panel, wherein the at least one restricting device comprises a restricting member; the restricting member has a connecting portion and a restricting portion; an end of the connecting portion is pivotally connected to the reverse surface of the display panel, another end of the connecting portion is connected to the restricting portion; the restricting portion of the restricting member is controllable to pivot to the reverse surface of the curved-surface support;

thereby, the display panel is fixed on the curved-surface support via the at least one restricting device; when there are a plurality of curved-surface displaying modules engaged with the curved-surface support, the displaying surface of the display panel of the plurality of the curved-surface displaying modules forms a curved displaying surface.

2. The curved-surface displaying module as claimed in claim 1, wherein the display panel comprises at least one upright post disposed on the reverse surface of the display panel; the at least one upright post has a longitudinal axis extending in a direction away from the reverse surface of the display panel; the connecting portion of the restricting member has an engaging hole; the restricting member fits around the at least one upright post via the engaging hole; the restricting portion of the restricting member is controllable to pivot around the longitudinal axis of the at least one upright post.

3. The curved-surface displaying module as claimed in claim 2, wherein the at least one restricting device comprises an elastic member and a fixing member; the elastic member fits around the at least one upright post; the fixing member is connected to an end of the at least one upright post away from the reverse surface of the display panel; an end of the elastic member abuts against the connecting portion, and another end of the elastic member abuts against the fixing member.

4. The curved-surface displaying module as claimed in claim 1, wherein the at least one restricting device comprises a plurality of restricting devices which are in groups of two and are oppositely disposed on the reverse surface of the display panel.

5. The curved-surface displaying module as claimed in claim 1, further comprising at least one leveling structure, wherein the at least one leveling structure has two through holes; each of the through holes has a first section and a second section; a minimum diameter of the first section is greater than a minimum diameter of the second section; the reverse surface of the display panel has at least one engaging member; the at least one engaging member has an engaging portion extending in a direction away from the reverse surface of the display panel and a head portion which are sequentially connected; an outer diameter of the head portion is greater than the minimum diameter of the second section and is smaller than the minimum diameter of the first section; a minimum outer diameter of the engaging portion is smaller than the minimum diameter of the second section; when there are two display panels adjacently disposed, the at least one leveling structure fits around the engaging portion of the at least one engaging member of the two display panels by respectively passing the head portion of the at least one engaging member of the two display panels through the first section of the two through holes; the at least one leveling structure is controllable to be moved relative to the at least one engaging member of the two display panels to make the at least one engaging member of each of the two display panels be located at the second section of one of the through holes.

6. The curved-surface displaying module as claimed in claim 5, wherein each of the through holes of the at least one leveling structure has a connecting section; two ends of the connecting section are respectively connected to the first section and the second section; the minimum diameter of the first section is greater than a minimum diameter of the connecting section; the second section extends along a first axis; the connecting section extends along a second axis; the first axis is not parallel to the second axis; the outer diameter of the head portion is greater than the minimum diameter of the connecting section; the minimum outer diameter of the engaging portion is smaller than the minimum diameter of the connecting section.

7. The curved-surface displaying module as claimed in claim 5, wherein the engaging portion of the at least one engaging member has a neck section and an engaging section; an end of the engaging section is connected to the reverse surface of the display panel, and another end of the engaging section is connected to the neck section; the neck section is connected to the head portion; an outer diameter of the neck section is smaller than an outer diameter of the engaging section; the outer diameter of the engaging section is greater than the minimum diameter of the second section.

* * * * *